United States Patent [19]

Snyder

[11] 4,043,274

[45] Aug. 23, 1977

[54] RAILWAY CAR NAILABLE DOOR POST

[75] Inventor: Richard C. Snyder, Michigan City, Ind.

[73] Assignee: Pullman Incorporated, Chicago, Ill.

[21] Appl. No.: 608,318

[22] Filed: Aug. 27, 1975

[51] Int. Cl.[2] ..... B61D 17/08; B61D 45/00; E04B 1/20; E04B 1/32

[52] U.S. Cl. ..... 105/409; 52/211; 52/376; 105/423; 105/480

[58] Field of Search ..... 105/422, 467, 479, 478, 105/423, 497, 475, 480, 369, 409, 481; 52/376, 211; 160/368 G

[56] References Cited

U.S. PATENT DOCUMENTS

| | | | |
|---|---|---|---|
| 1,600,946 | 9/1926 | Joiner | 52/211 |
| 1,682,281 | 8/1928 | Joiner | 52/211 |
| 1,688,016 | 10/1928 | Klaasen | 52/376 |
| 1,853,680 | 4/1932 | Hartbauer | 52/376 |
| 2,134,674 | 10/1938 | Sherman et al. | 52/376 |
| 2,167,835 | 8/1939 | Greulich | 52/376 |
| 2,884,874 | 5/1959 | Molt | 105/409 |
| 2,900,926 | 8/1959 | Neuhart | 105/423 |
| 3,068,967 | 12/1962 | Oakley | 105/409 X |
| 3,089,436 | 5/1963 | Buckley | 105/481 |
| 3,585,942 | 6/1971 | Shaver | 105/409 |
| 3,899,016 | 8/1975 | Bakken | 160/368 G |

*Primary Examiner*—Robert J. Spar
*Assistant Examiner*—Howard Beltran
*Attorney, Agent, or Firm*—Richard J. Myers

[57] ABSTRACT

A nailable door post for a freight car in which the post comprises a pair of upright metal members which tightly embrace a wooden nailing strip which is held captive between a transverse wall of the outer member and a transverse offset portion in a longitudinal wall of the inner member, the post being flanked on its inner and outer sides by the longitudinal walls of the inner and outer members, the longitudinal wall of the inner member being provided with nail holes aligned with the wooden strip.

The strip is held along the edge of the post remote from the door edge and there being a hollow in the post structure between the door edge and the wooden strip so that if the metal members are distorted, if struck by a heavy object, the strip will remain intact. The offset in the inner member longitudinal wall provides a pocket in which is secured a vertical lading strap anchor disposed in non-obstructing position inwardly of the plane of the inner side of the side wall of the freight car.

9 Claims, 5 Drawing Figures

RAILWAY CAR NAILABLE DOOR POST

DISCUSSION OF THE PRIOR ART

The references uncovered in a search of the art show a variety of grain door nailers, namely U.S. Pat. 1,600,946; 1,682,281; 1,853,680; and 2,884,874. Each of these door nailers require at least one additional structural element (over the two provided by applicants) to secure the lumber to the post such as, for example, the strip 23 and screws 24 of U.S. Pat. No. 2,884,874.

U.S. Pat. No. 2,167,835 also found in the search reveals an I-beam having a length of lumber with its upper and lower edges entirely surrounded by metal and subjected to spring pressure to hold the wood in place. Portions of the enclosing walls must be bent about the wooden strip 10 to hold it in place. There is no suggestion of a practical structure which can be fabricated in a simple assembly as a freight car door post.

SUMMARY OF THE INVENTION

This invention relates to railway freight car door post structures in which a pair of upright metal members are configured to complementally fit together and form a hollow steel door post in embracing relation to a wooden strip, the steel post functioning to protect the nailing strip against wear and splitting during movement of the cargo through the door.

A principal object of the invention is to provide a novel door post structure in which the upright inner and outer steel members have longitudinal walls which embrace the inner and outer sides of the wooden nailing strip and the outer steel member has a transverse wall opposing one lateral edge of the post and the inner member having on its longitudnal wall an inwardly offset channel shaped portion which flanks the opposite lateral edge of the nailing strip and the offset portion confining a lading strap anchor therein so that the strap does not protrude into the interior of the car and the post presents a non-obstructing flat profile coplanar with the interior wall surface of the box car.

The invention in general terms provides a novel two-piece steel structure which confines a wooden nailing strip in a simple but effective assembly.

These and other objects of the invention will become more readily apparent from the specification and the drawings wherein.

DESCRIPTION OF THE INVENTION

Figure 1:
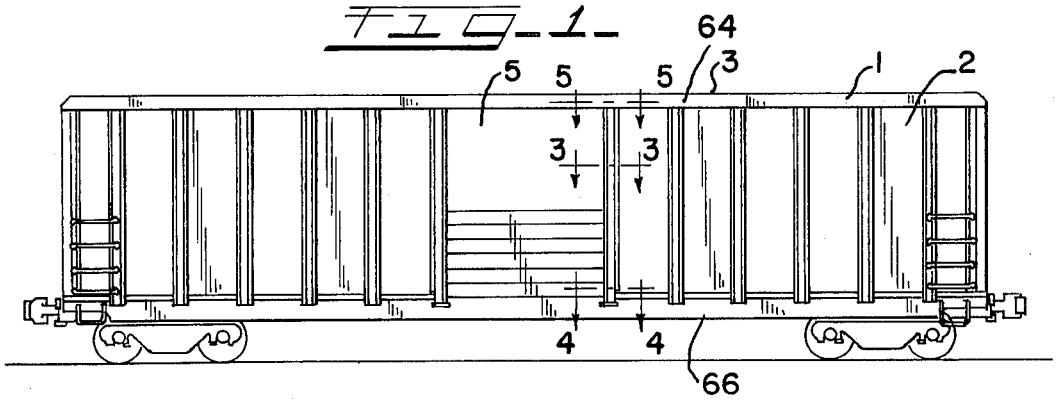
FIG. 1 is a side elevational exterior view of one side of a box car incorporating the invention.
Figure 2:
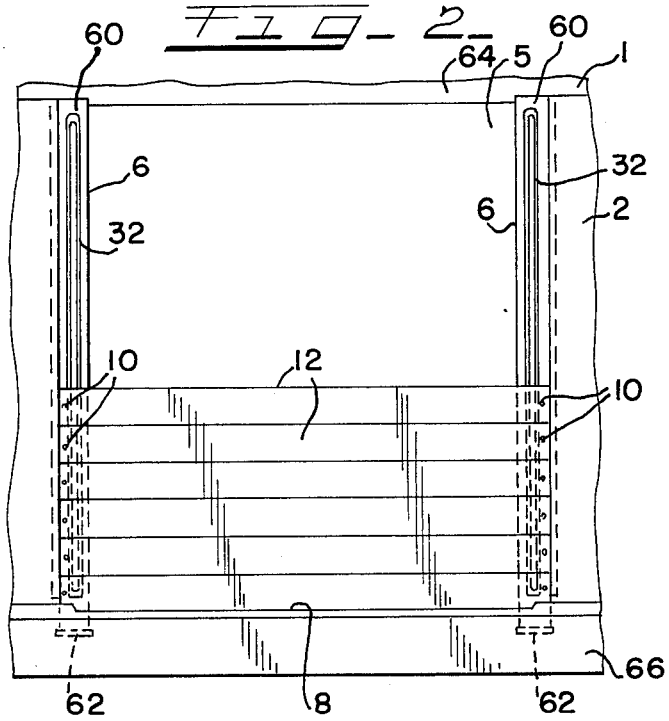
FIG. 2 is an enlarged fragmentary interior view of the door portion of the box car illustrating the invention.
Figure 3:
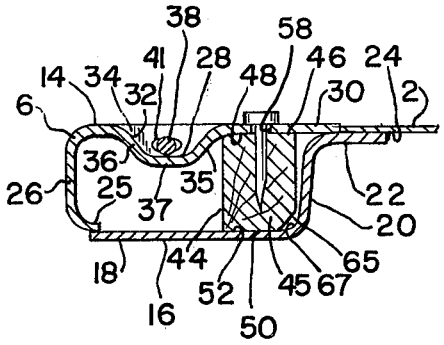
FIG. 3 is an enlarged transverse horizontal sectional view taken substantially on line 3—3 of FIG. 1.
Figure 4:
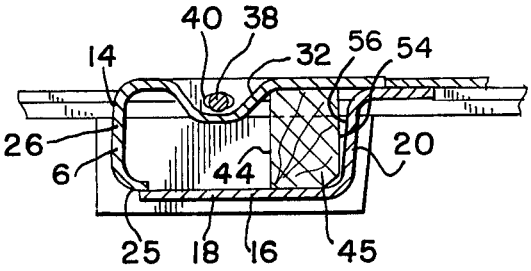
Fig. 4 is an enlarged transverse horizontal sectional view taken substantially on line 4—4 of FIG. 1.
Figure 5:
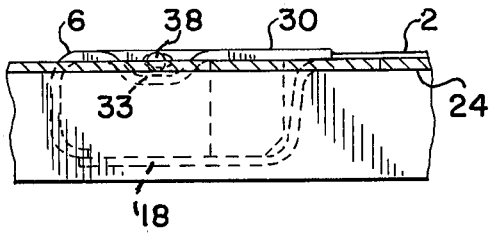
FIG. 5 is an enlarged horizontal sectional view taken substantially on line 5—5 of FIG. 1.

Reference is made to the drawings wherein there is shown a typical freight car generally designated 1 which comprises a side wall 2, a roof 3 and a door (not shown) in a doorway 5 defined by novel vertical door posts 6, 6. Each door post is held by welding to the side wall 2 above the floor 8. Nails 10 hold lading holders 12 which span the doorway. The holders may be wooden boards nailed across the doorway to hold in grain, for example.

Each door post comprises inner and outer vertical members 14 and 16. The outer member has a longitudinal outer wall 18 which extends parallel with the side wall 2 of the freight car and is spaced outwardly therefrom. Wall 18 joins the outer edge of a transverse wall 20 which at its inner edge merges into a longitudinal flange 22 which lays against the outer side 24 of the side wall 2 of the freight car and is welded thereto. The outer member is somewhat Z-shaped in cross-section and its outer wall overlaps the outer flange 25 of the door-framing C-section portion 26 of the inner member 14 of the door post.

The inner member 14, in addition to the door-framing section 26, comprises an adjoining concavoconvex section 28 in the inner longitudinal wall 30. The section 28 provides a well 32 which is formed by upper, lower and side webs 33, 34, 35 and 36 which converge into the post and merge into an inner web 37. These webs form a narrow vertically elongated pocket or well 32 in which is positioned an anchor bar or rod 38 which at its upper and lower ends passes through openings 40 and 41 in the upper and lower webs 33 and 34.

The side web 35 flanks a lateral side 44 of a wood nailing strip 45 and the strip 45 has its inner face 46 in engagement with the outer face 48 of the longitudinal wall 30 and has its outer face 50 in engagement with the inner face 52 of the longitudinal wall 18 of the outer post member 16. The opposite lateral side 54 of the strip 45 opposes the inner face 56 of transverse wall 20.

A vertical series of nailing holes 58 are provided in the longitudinal wall 30 through which the nails 10 are nailed into the post. The wooden strip also reinforces the metal post structure which at its upper and lower ends 60 and 62 is suitably connectedeither by rivets or welding to the upper and lower sills 64 and 66 of the side wall 2 of the freight car. The strip is preferably square and has a chamfered corner 65 opposing an interior corner 67 of the outer member's longitudnal and transverse walls.

It will be understood that the wood strip is inserted between the vertical steel inner and outer members or sections. The upper and lower ends of the inner and outer sections are connected to the upper and lower side sills and the flange 22 is welded to the side wall of the box car.

It will be apparent that a novel, simple post structure has been provided having minimal parts and in which the wooden and steel parts are mutually reinforcing. Rigid sections are provided in critical areas which cooperate to hold the wooden nailing strip within the post.

Having described a preferred embodiment of the invention, it will be apparent that it is intended to cover such variations as set forth in the appended claims.

What is claimed is:

1. In a freight car, a vertically extending nailable metal and wood door post for a door opening in the car side wall comprising:

inner and outer vertical metal post members, means securing said members to the side wall, one of said members having a first transverse wall remote from the door opening, a wooden nailing strip tightly interposed between said members and seated against said wall and spaced laterally away from the door opening, means on one of said members for holding said strip within the post against said transverse wall, and one of said members having a wall defining a side of said opening and deflectible longitudinally of the side wall and slidable along the other of said members.

2. The invention according to claim 1, and said holding means comprising a transverse wall portion of said outer member remote from the door edge and a portion on the inner member offset inwardly of the post and flanking a side of the strip adjacent to said doorway edge.

3. The invention according to claim 2, and said offset portion providing a cavity facing into the interior of the freight car, and a lading anchor secured to said offset portion within said cavity in non-obstructing position to the interior side of the car.

4. The invention according to claim 3, and said inner and outer members forming essentially a box section having opposing sides including a deformable doorway edge portion having a transverse wall and a longitudinal outer edge flange and a longitudinal inner wall.

5. The invention according to claim 4, and said strip having flat inner and outer sides in complementary engagement with said inner and outer members, respectively.

6. The invention according to claim 5, and said box section generally defining four corners, and said inner and outer members overlapping each other solely at diagonally opposite corners of the post structure.

7. The invention according to claim 6, and said offset portion extending only partially into the post and overlapping a corner portion of the strip.

8. The invention according to claim 1, and said post being essentially quadrilateral and having a chamfered corner opposing an interior corner formed by transverse and longitudinal wallsof said outer member.

9. The invention according to claim 1, and said inner member having a portion C-shaped in cross-section disposed along the doorway edge, said portion having a flange extending parallel to an outer longitudinal wall of the outer member and in slidable engagement therewith.

* * * * *